US005265292A

United States Patent [19]

Underell

[11] Patent Number: 5,265,292

[45] Date of Patent: Nov. 30, 1993

[54] FOLDABLE LOUNGE CUSHION

[75] Inventor: Raymond R. Underell, Del Mar, Calif.

[73] Assignee: Pauline Green, Del Mar, Calif.

[21] Appl. No.: 28,543

[22] Filed: Mar. 8, 1993

[51] Int. Cl.[5] ..... A47G 9/06

[52] U.S. Cl. ..... 5/419; 5/420; 297/380

[58] Field of Search ..... 5/417–420, 5/465; 297/380, 381; 190/1, 2; D6/368

[56] References Cited

U.S. PATENT DOCUMENTS

| | | | |
|---|---|---|---|
| D. 299,988 | 2/1989 | Parabita | 5/420 |
| 2,623,574 | 12/1952 | Damsch | 297/380 |
| 2,857,957 | 10/1958 | Gay | 5/420 |
| 3,808,616 | 5/1974 | White | 5/419 |
| 4,518,203 | 5/1985 | White | 5/465 |
| 4,654,907 | 4/1987 | Haugaard | 5/420 |
| 4,926,512 | 5/1990 | Coyle | 5/417 |
| 5,020,854 | 6/1991 | Powell | 5/419 |

*Primary Examiner*—Alexander Grosz
*Attorney, Agent, or Firm*—Frank D. Gilliam

[57] ABSTRACT

A foldable recliner/lounge pad having four cushions interconnected with wide hinges to allow folding the cushions together for carrying and support. The cushions have cloth exteriors and are interiorly foam padded. Two of the cushions that can be used as a back support have rigid centers sandwiched between layers of foam. Strap are used for carrying and locking the back support pads in an upright back support position.

8 Claims, 1 Drawing Sheet

FOLDABLE LOUNGE CUSHION

BACKGROUND OF THE INVENTION

The invention is directed to a lounge cushion and more particularly to a foldable lounge cushion which includes a novel positional back rest support which can be selectively angled and locked in position at that selected angle.

There have been various prior art attempts to design different types of lounging cushions some of which have found limited commercial use.

U.S. Pat. No. 2,857,957 teaches a lawn or patio lounge which includes a plurality of interconnected sections or cushions, four cushions shown, with one of the cushions used as a head or back rest. The back rest cushion is angled from the supporting surface at a predetermined fixed angle. By physically repositioning the back rest cushion, the back rest cushion can be used as a head rest which has a less severe angle from the supporting surface. There is no means for adjusting the back rest cushion at a selected angle with the supporting surface and there is no means for securing the back rest against slipping out from under the person resting thereon unless the lounge is positioned over a holding spike penetrable surface.

U.S. Pat. No. 3,808,616 teaches a three cushion free form assembly which includes a back rest which can be angle adjusted relative to a adjacent cushion. The back rest angle is established and the cushion is held at that angle by a pair of telescopic struts which are removably attached to the upper corner of the back rest cushion. The struts are length adjustable at a plurality of discrete predetermined lengths. There are no length adjustments between the discrete predetermined lengths.

U.S. Pat. No. 4,654,907 teaches a folding recreation chair-pad using three hinged together cushions, A first cushion is constructed of covered foam and a second and third cushion are formed of foam covered plywood. The second plywood cushion includes a right angle extension on the side adjacent to the third foam covered plywood cushion. The right angle extension is for receiving the adjacent side of the third foam covered plywood section to support the second and third foam covered plywood sections at an angle determined by the spaced apart attachment of the opposite sides of the two foam covered plywood cushions to fixed in length cloth extension.

U.S. Pat. No. 4,926,512 teaches a folding paperboard beach chair formed from an integral scored blank of paperboard. The body portion has two spaced-apart and transverse score lines which define a bottom leg support panel, a middle seat support panel, and a top back support panel wherein the bottom and top panels are adapted to be folded so as to overlay the middle panel. A plurality of spaced-apart foldable support panels extend across the of the top back support panel when the chair is folded. An aperture is provided adjacent to the side edge of each of the top, middle, and bottom panels and positioned so as to be in vertical registration and to thereby form a carrying handle when the chair is folded into closed configuration with the top and bottom panels overlaying the middle panels thereof.

U.S. Pat. No. 5,020,854 teaches a folding chair formed from sheet material including a seat panel, a back panel, a support panel, an end panel and brace panels connected to the support panel and extending between the back panel and end panel. The angle of the back panel relative to the seat panel is determined by the space between surface penetrating projections carried by the back panel and the brace panel and depends on the penetration of the projections in the support surface to maintain the back panel relative angle relative to the seat panel.

None of the prior art devices teach positive means for securing the back rest at a user selected angle relative to the support surface. The prior art teaches either that the back rest is fixedly positioned in a preestablished position by construction means, allows only for back rest angle changes and angle position holding means that depend on penetration into the support surface or provides only a friction with the support surface by the weight of the seat occupant.

There has not been a foldable recliner/lounge chair-pad which has a back rest which is infinitely adjustable through a range of angles with the support surface and can be locked in that selected angled position by positive securing means until the emergence of the instant invention.

SUMMARY OF THE INVENTION

The invention is directed to a foldable lounge pad device which has four interconnected cushions. A first two adjacent cushions are constructed of a central foam cushion covered with a layer of foam with an outer cloth material fused thereto and a second two interconnected adjacent cushions one of which in connected to one of the foam pads. The second two have rigid centers covered on each side thereof with a like thin layer of foam with soft cloth material fused thereto as fore mentioned. Each of the adjacent cushions are interconnected by a wide hinge formed from the soft cloth with the thin layer of foam fused thereto so that they can be folded together to form a small compact flat profile package for storage or transport. The wide hinge between the cushions formed with the rigid centers allows the second two rigid cushions to form a angled back rest cushion for the person using the recliner/lounge pad and the distal one of the second two cushions supports the other of the second two cushions, i.e. the back rest cushion. Either the back rest cushion or the distal support cushion rests against the other and is held in position by the hinge for maintaining the back rest support at the desired angle with the support surface.

Preferably the back rest cushion will rest against the support cushion and be supported thereby. A strap attached to a hinge extends around the lower distal end of the support cushion has either hook or eye attachment means on the side adjacent to the support cushion and is removably attachable to the bottom surface of the support cushion which has the opposite engaging eye or hook of a hook and loop type fastener, such as the one sold under the Trademark of Velcro. It should be understood that any convenient fastening means suitable for the purpose intended may be used to practice this invention to prevent relative movement between the two cushions from the selected angle therebetween. In addition, the Velcro type fastening means attached to the support cushion extends to the surface adjacent to the recliner/lounge pad support surface with a small area thereof engaging the support certain surface thereby aiding in preventing relative movement between the back rest cushion and support cushion.

When the cushion is not in use the strap in combination with two looped straps attached to the second and third cushions acts as a shoulder strap or handle for transporting the lounge.

An object of this invention is to provide a portable recliner/lounge pad that can be both a cushion for the user's body to rest upon in a prone position or to provide a selectively angled back rest for a person resting on the lounge pad as desired.

An object of this invention is to provide the back rest cushion with infinitely selected angles between 0 to about 90 degrees.

Another object of the invention is to provide a locking means to prevent movement between the back rest cushion and the back rest support cushion at any selected angle within a range of angles.

Another object of this invention is to provide a combination back rest cushion angle locking means that can also be used as a shoulder strap or handle for easy personal transport of the recliner/lounge pad of this invention.

Still another object of this invention is to provide a multi-cushion lounge pad that can be folded into a small package for transport or storage when not in use.

Yet another object of this invention is to provide an outer cover for recliner/lounge pad of the invention with a thin layer of foam fused thereto to add a long ware life to the cover by prevention relative movement between the outer cloth cover and inner thin layer of foam.

These and other objects and advantages of the present invention will become apparent to those skilled in the art after considering the following detailed specification in which the preferred embodiment are described in conjunction with the accompanying drawing Figures.

BRIEF DESCRIPTION OF THE DRAWING FIGURES

DESCRIPTION OF THE PREFERRED EMBODIMENT

Figure 1:
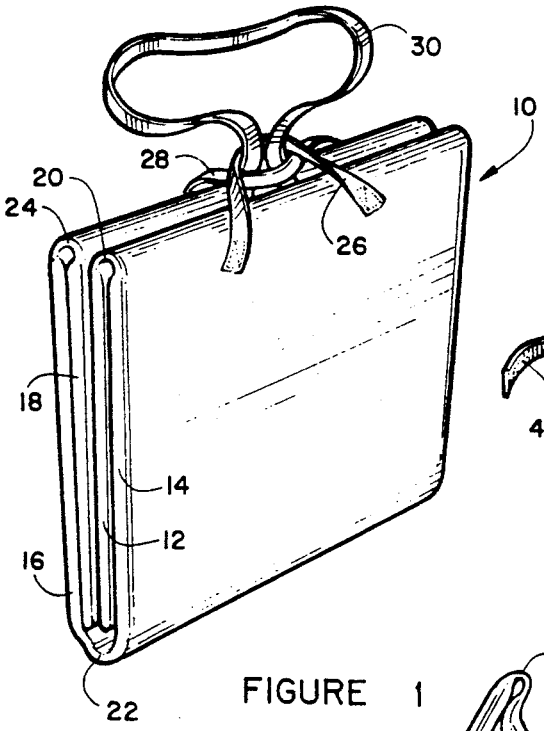
FIG. 1 depicts the lounge pad of the invention in a stowed non-use configuration.

Referring now to the various drawing Figures, FIG. 1 depicts the lounge pad 10 of the invention in a stowed ready for transport or storage. The lounge pad is formed by a plurality of individual interconnected cushions 12, 14, 16 and 18 which are shown folded together about wide cloth hinge members 20, 22 and 24. The wide hinge members allow the cushions to be folded into a closely adjacent parallel configuration as shown in drawing FIG. 1 for storage or transport or for supporting the two angled cushions in the drawing FIG. 3 configuration hereinafter explained in more detail.

A pair of cloth belt loops 26 and 28 are attached to cushions the 14 and 16 respectfully by stitching to the outer cloth/foam covering the cushions. A cloth locking strap 30, herein after explained in more detail, is attached to hinge member 22 and is shown extending through the belt loops 26 and 28 for use as a shoulder strap or handle for transport of the lounge pad 10.

Figure 2:
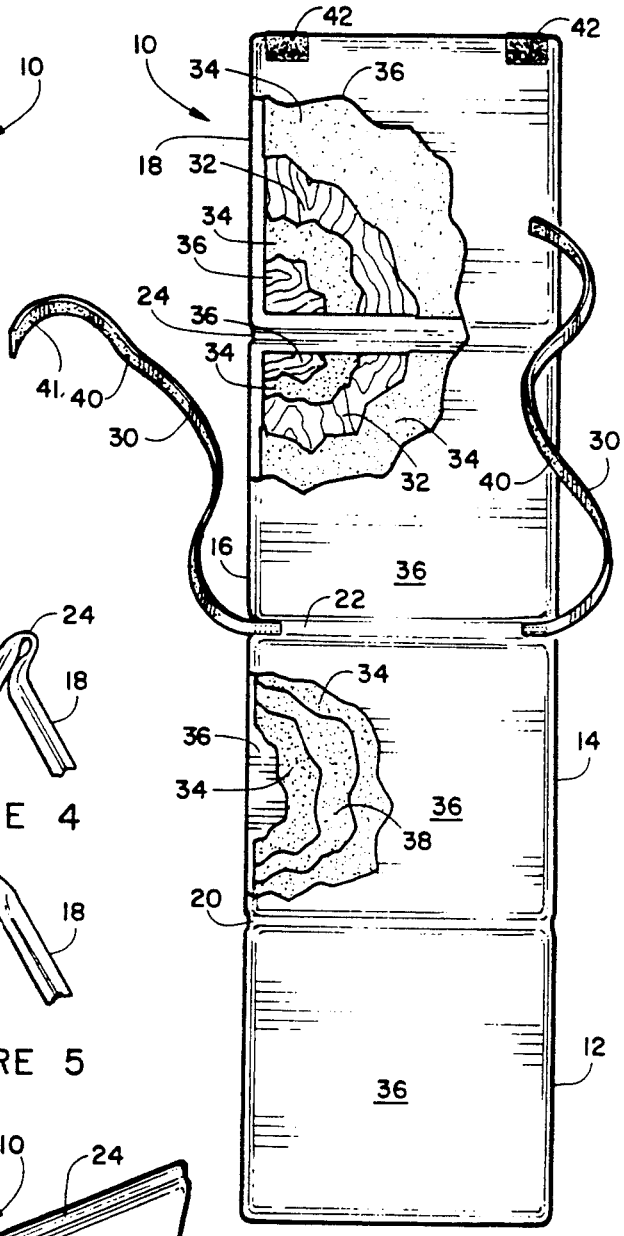
FIG. 2 depicts the lounge pad of the invention in a extended position with all four cushions being on a common plane.

Referring now to drawing FIG. 2 which depicts the cushions 12–18 extended to be all on the same plane. Cushions 16 and 18 are formed with a rigid center surface 32, generally plywood or the like, with a thin layer of foam 34 on each side thereof. The foam 34 is fused to a soft cloth material 36. The fusing is accomplished by heating the foam to a liquid on the surface adjacent to the soft cloth material causing the liquid formed to penetrates the pores of the soft material forming a permanent bond when cooled and again solidified. the fusing prevent relative movement between the foam and the soft cloth increasing the durability of the covering.

Figure 3:
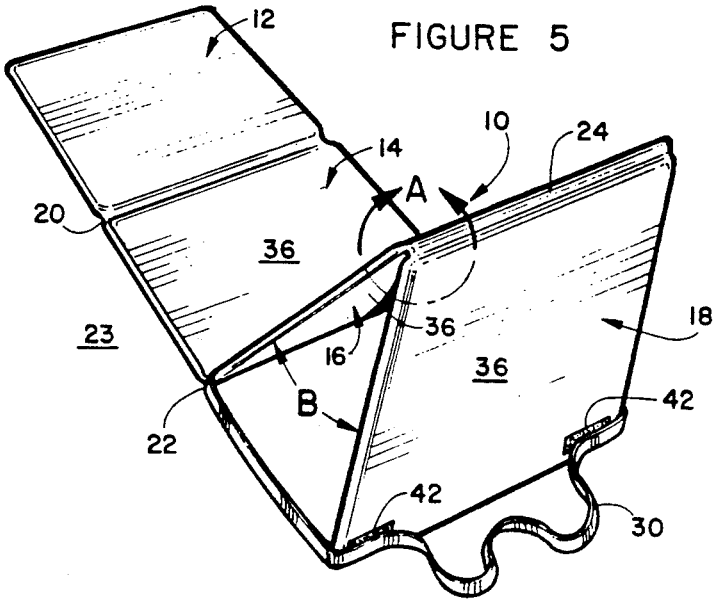
FIG. 3 depicts the lounge pad with in a back rest angled position with the lock strap in position.

The cushions 12 and 14, see drawing FIG. 3, are constructed with a foam center 38 with an outer cover formed by fused together cloth material 36 and a thin layer of foam 34. The hinges 20, and 24 are formed from the fused together soft cloth material 36 and thin layer of foam 34. The hinges are sufficiently wide to allow the cushions to fold together as shown in drawing FIG. 1 and to allow the relative positioning of cushions 16 and 18 to form a selected angle therebetween as shown in drawing FIGS. 4 and 5.

The cushions 12, 14, 16 and 18 are generally of the same physical size and thickness as shown in the various drawing Figures.

Cloth locking strap 30 is shown attached to hinge 22. The locking strap 30 can be a continuous loop between its attachment ends at hinge 22 as shown in FIGS. 1 and 3 or can be of open form at the opposite end from its attachment ends as shown in FIG. 2.

Figure 4:
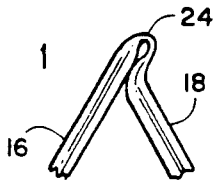
FIG. 4 depicts a showing a first support relationship between the adjacent back rest and support cushions taken along section A of FIG. 3.
Figure 5:
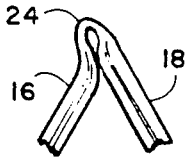
FIG. 5 depicts a showing a second support relationship between the adjacent back rest and support cushions taken along section A of FIG. 3.

Referring now to FIGS. 3, 4 and 5, which depicts the cushions 12 and 14 positioned along a common plane and cushions 16 and 18 forming an angled back support. The hinge 22 is sufficiently wide to allow the cushions 16 and 18 to be held one against the other as shown in drawing FIGS. 4 and 5 for maintaining relative support therebetween. The angle between the cushions 16 and 18 can be arranged at any selected angle "B". The FIG. 3 showing is an intermediate angle between the minimum and maximum angle extremes.

As shown in drawing FIG. 3, the locking strap 30 includes an inner surface 40 of either the hook or eye portion of a hook and eye type fastening system with the opposite portion 42 thereof being attached to the surface of cushion 18 adjacent to and in contact with the support surface 23 whereby after the selected angle "B" between the cushions 16 and 18 is established the inner surface of the lock strap 30 is removably connected to the opposite connector portion 42. The strap 30 connection to portion 42 maintains the established angle formed between the cushions 16 and 18. The position of fastener portion 42 allows engagement of the fastening material to form a friction connection with the supporting surface 23 aiding in the maintenance of the selected back rest angle. End 41 of strap 30 has either hook or eye fastening material opposite from inner surface 40 so that the two ends of lock strap 30 can be interconnected to form a complete loop as shown in FIGS. 1 and 3 for transport.

The strap 30 and loops 26 and 28 can be formed of Nylon woven material or from any other material suitable for the purpose intended.

While the present invention has been described with reference to a particular embodiment thereof, it will be understood that numerous modifications can be made by those skilled in the art without actually departing from the scope of the invention. Accordingly, all modifications and equivalents may be resorted to which fall within the scope of the invention as claimed.

What is claimed is:

1. A foldable recliner/lounge pad which comprises:

four cushions, said four cushions comprising a first adjacent pair of cushions formed with a central layer of foam material and covered with a soft cloth having a thin layer of foam fixedly attached thereto to prevent relative movement therebetween and a second pair of adjacent cushions, adapted to provide back support for a user of the pad, formed with rigid centers and covered with said layer of soft cloth having a thin layer of foam fixedly attached thereto;

a wide hinge member interconnecting each of the adjacent cushions, said wide hinge member between said adjacent cushions being sufficiently wide to allow said four cushions to be folded in a closely related parallel configuration for storage or transport and provide support for said second pair of adjacent cushions at a selected angle therebetween when said foldable recliner/lounge pad is in use; whereby, when the pad is positioned on a support surface, the first adjacent pair of cushions are in contact with the support surface to provide support for the lower body portions of a sitting or reclining user, and the second adjacent pair of cushions are positioned at a selected angle relative to each other, such that they provide a back support for a sitting or reclining user and combination carrying and locking means for transport of said foldable recliner/lounge pad when not in use and for maintaining said angle between said second pair of adjacent cushions when said foldable recliner/lounge pad is in use, said locking means comprising strap means.

2. The invention as defined in claim 1 wherein said four cushions have substantially the same configuration and thickness.

3. The invention as defined in claim 1 wherein said strap means is fixedly attached to the wide hinge member interconnecting one of said first pair of cushions to one of said second pair of cushions, closed loops are fixedly attached to said one of said first pair of cushions and to one of said second pair of cushions and strap attachment means are provided on the distal end of the distal one of said second pair of cushions, whereby when said foldable recliner/lounge pad is in a folded position said combination carrying and locking means is passed through said closed loops and becomes a carrying handle for said foldable recliner/lounge pad when in a folded configuration and said strap means is connected to said strap attachment means when said second pair of cushions means are at said selected angle.

4. The invention as defined in claim 3 wherein said strap means and said strap attachment means are opposing hook and eye type fastening means.

5. The invention as defined in claim 3 wherein said strap means comprises two straps.

6. The invention as defined in claim 3 wherein said strap means is a single closed loop strap.

7. The invention as defined in claim 3 wherein said strap attachment means engages a support surface when said foldable recliner/lounge pad back support is at a selected angular position thereby providing a friction engagement with said support surface aiding in maintaining said selected angular position.

8. The invention as defined in claim 1 wherein said soft cloth and thin layer of foam are fixedly attached by fusion bonding whereby the foam penetrates the pores of said soft material.

* * * * *